US005245391A

United States Patent [19]

Suzuki et al.

[11] Patent Number: 5,245,391

[45] Date of Patent: Sep. 14, 1993

[54] DEVELOPING DEVICE HAVING SURFACE MICROFIELDS FOR AN IMAGE FORMING APPARATUS

[75] Inventors: Koji Suzuki, Yokohama; Naoki Iwata, Tokyo; Yuichi Ueno; Shigekazu Enoki, both of Kawasaki; Junko Tomita, Tokyo, all of Japan

[73] Assignee: Ricoh Company, Ltd., Tokyo, Japan

[21] Appl. No.: 862,002

[22] Filed: Apr. 1, 1992

[30] Foreign Application Priority Data

| | | | |
|---|---|---|---|
| Apr. 1, 1991 | [JP] | Japan | 3-96461 |
| Apr. 11, 1991 | [JP] | Japan | 3-78942 |
| Apr. 13, 1991 | [JP] | Japan | 3-108659 |

[51] Int. Cl.[5] ..... G03G 21/00

[52] U.S. Cl. ..... 355/246; 118/651; 118/653; 118/656; 355/259

[58] Field of Search ..... 355/245, 246, 251, 253, 355/259, 261, 262; 118/647, 648, 651, 653, 656–658

[56] References Cited

U.S. PATENT DOCUMENTS

| | | | |
|---|---|---|---|
| 3,203,394 | 8/1965 | Hope et al. | 355/259 X |
| 3,759,222 | 9/1973 | Maksymiak et al. | 355/259 X |
| 4,114,261 | 9/1978 | Weiler | 118/651 X |
| 4,515,106 | 5/1985 | Kohyama | 118/651 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A developing device incorporated in an image forming apparatus and having a developing roller or similar image carrier for transporting a developer to a photoconductive element or similar image carrier to develop an electrostatic latent image formed on the image carrier. The developing roller is configured to form microfields on the surface thereof. An alternating voltage is applied to the developing roller as a bias voltage for development to thereby deposit a non-magnetic toner on the surface of the roller. Silica particles are admixed with the toner. The developing device is operable with an adequate developing bias at all times.

13 Claims, 11 Drawing Sheets

DEVELOPING DEVICE HAVING SURFACE MICROFIELDS FOR AN IMAGE FORMING APPARATUS

BACKGROUND OF THE INVENTION

The present invention relates to a developing device for an electrophotographic copier, printer, facsimile transceiver or similar image forming apparatus and, more particularly, to a developing device having a developing roller or similar image carrier for transporting a developer to a developing station where the image carrier faces an image carrier, thereby developing a latent image electrostatically formed on the image carrier.

A conventional developing apparatus for the above application has a developing roller or similar developer carrier for carrying a thin layer of developer thereon and facing a photoconductive element or similar image carrier at a developing station. An electric field is developed at the developing station to transfer the developer from the developing roller to the photoconductive element, thereby developing an electrostatic latent image formed on the photoconductive element. In this type of developing device, a threshold value exists regarding the transfer of the developer from the developing roller to the photoconductive element. This brings about a problem that the developed image has poor tonality since the developer scarcely deposits in an image portion whose surface potential is lower than the threshold value, although it deposits in an image portion whose surface potential is higher than the threshold value. To eliminate this problem, an alternating electric field of relatively low frequency may be formed at the developing station, as disclosed in, for example, Japanese Patent Publication No. 1013/1989. However, when such an alternating electric field is simply applied to the developing station, conditioning the electric field for higher tonality lowers the image density while conditioning it for higher image density unwantedly increases the width of lines of an image.

Moreover, when the above-described type of developing device is operated with developer in the form of a non-magnetic toner, the toner forms powder clouds when moved back and forth between the developing roller and the photoconductive element, lowering the image density to a critical extent (see Japanese Patent Publication No. 14706/1990, for example).

SUMMARY OF THE INVENTION

It is therefore an object of the present invention to provide a developing device which insures high image quality, i.e., high image density and high reproducibility of lines.

In accordance with the present invention, a developing device incorporated in an image forming apparatus for developing, in a developing region, an electrostatic latent image formed on an image carrier by a non-magnetic developer to which silica particles are added comprises a bias source for applying a bias voltage to the developing region, and a developer carrier for forming a number of microfields on the surface thereof. The developer is controllably moved by an electric field determined by a potential deposited on the image carrier, an electric field developed by the bias voltage applied from the bias source, and an electric field developed on the developer carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
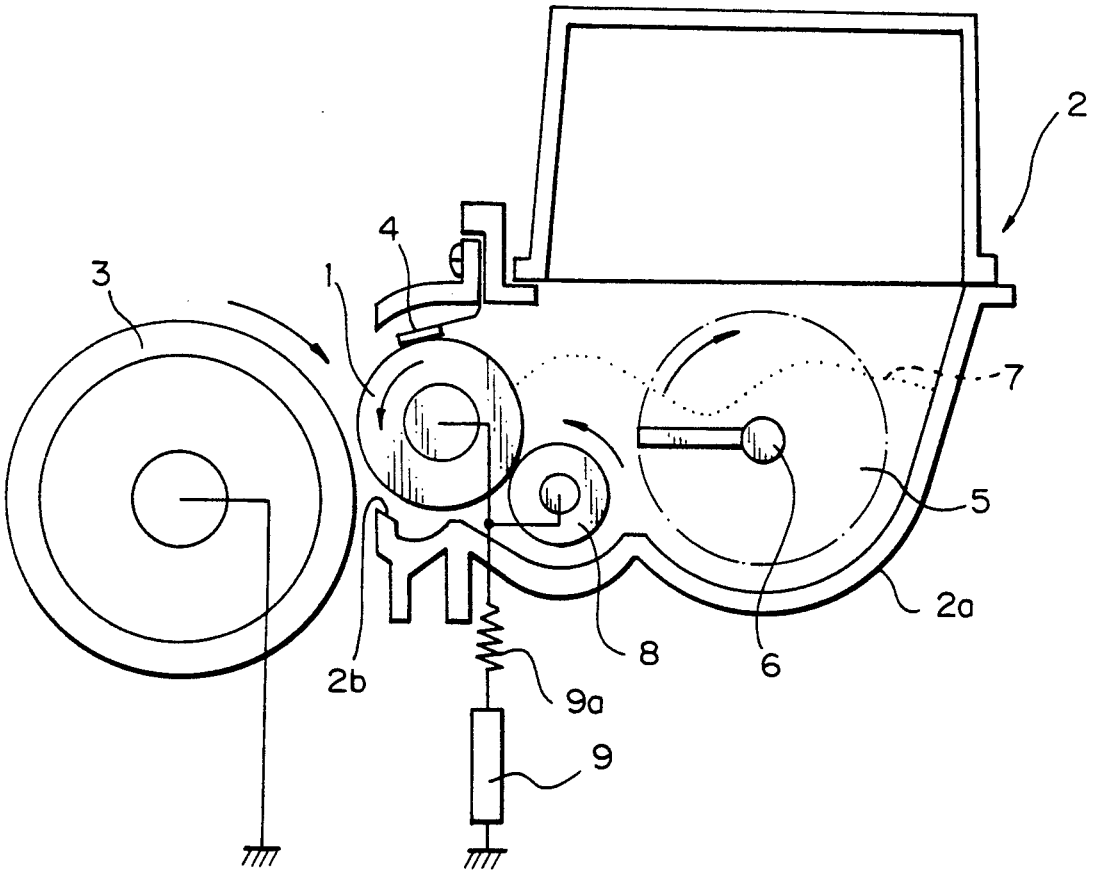
FIG. 1 is a sectional side elevation showing a developing device embodying the present invention.

Referring to FIG. 1, a developing device embodying the present invention is shown and generally designated by the reference numeral 2. As shown, the developing device 2 has a casing **2*a* which is formed with an opening 2*b* in a position where it faces a photoconductive drum 3. A developing roller, or developer carrier, 1 is disposed in the casing 2*a* to face the drum 3 at a predetermined distance. A toner reservoir 5 is formed in the casing 2*a* and stores a toner 7 therein. A blade 4 is disposed above the developing roller 1 and elastically pressed against the roller 1 for regulating the thickness of a toner layer formed on the roller 1. Specifically, while an agitator 6 and a toner supply roller 8 are rotated to feed the toner 7 from the toner reservoir 5**, the blade 4 regulates the thickness of the toner 7. The blade 4 may be implemented as a regulating roller or a regulating belt, if desired. The agitator 6 is rotatable clockwise, as indicated by an arrow in the figure, so as to move the toner 7 to the left while agitating it. In the illustrative embodiment, silica particles are admixed with the toner 7 which is non-magnetic. Such a toner 7 is desirable for reasons which will be described later.

The toner supply roller 8 may be constituted by sponge produced by causing, for example, urethane rubber to foam or by a brush constituted by fibers of polyester rubber, tetrofluoroethylene resin or similar material. The toner supply roller 8 rubs the toner 7 fed from the agitator 6 against the surface of the developing roller 1 in either of forward and reverse directions to thereby supply the former to the latter. At the same time, the toner supply roller 8 scrapes off the toner 7 left on and returned by the developing roller 1 thereto. The toner 7 so supplied to the surface of the developing roller 1 is charged by the frictional charge ascribable to the friction of the rollers 8 and 1 and, therefore, electrostatically deposited on the roller 1. As a result, the toner 7 is conveyed by the developing roller 1 to a developing region where the roller 1 faces the drum 3 while having the thickness thereof regulated by the blade 4. The blade 4 may be constituted by a leaf spring and urethane or similar material adhered to the leaf spring or only by a resilient member. The blade 4 may be located in either of trailing and leading positions with respect to the direction of rotation of the developing roller 1 (trailing position in the embodiment).

Bias applying means 9 is connected to the developing roller 1 and toner supply roller 8. While in the embodiment the rollers 1 and 8 share the single bias applying means 9, they may each be provided with independent bias applying means. Further, the bias applying means 9 may also be connected to the blade 4, if desired. The toner 7 is transferred from the developing roller 1 to a latent image electrostatically formed on the drum 3 in an amount matching the latent image, while the bias voltage is applied to the roller 1. As a result, the toner 7 develops the latent image to produce a corresponding toner image. The developing roller 1 substantially does not contact the drum 3, i.e., the former is located at a distance of 30–500 μm, preferably 50–250 μm, from the latter. This eliminates the need for a heavy torque as would be indispensable in the event of contact development, thereby allowing a miniature motor to be used. To further reduce the torque, the developing roller 1 may be rotated at the same peripheral speed as the drum 3.

For the bias voltage, use may be made of a combination of DC and AC electric fields. Regarding the AC electric field, a pulse electric field having a rectangular waveform may be set in a low frequency range of 300–2000 Hz, preferably 500–1500 Hz, and the duration of a high voltage portion and that of a low voltage portion may each be provided with a particular ratio to the duration of one cycle. Then, the resulting image will have desirable sharpness in a low voltage portion and desirable image density in a high voltage portion and, in addition, will suffer from a minimum of contamination in the background. The optimal ratio between the durations of the high voltage and low voltage portions, i.e., optimal duty ratio depends on the polarity of the latent image and that of the toner 7. Assuming that a negatively charged latent image is developed by a negatively charged toner 7 by reversal development, for example, the ratio between the duration of a high voltage portion (above −100 V) and the duration of a low voltage portion (below −800 V) may be selected to be 5–18: 2–8. In the event of regular development, as distinguished from reversal development, such a ratio may be reversed. The resulting image will also have desirable sharpness in a low voltage portion and a desirable image density in a high density portion and, in addition, will suffer from a minimum of contamination in the background.

To prevent the bias for development from leaking, it is preferable to connect a resistor 9a in series with the bias applying circuit intervening between the bias applying means 9 and the developing roller 1 so as to limit the maximum current of the bias. The maximum current should preferable be about 0.5 mA when the roller 1 is spaced apart from the drum 3, as illustrated, or about 0.3 mA when the former contacts the latter, although not shown.

Figure 2A:
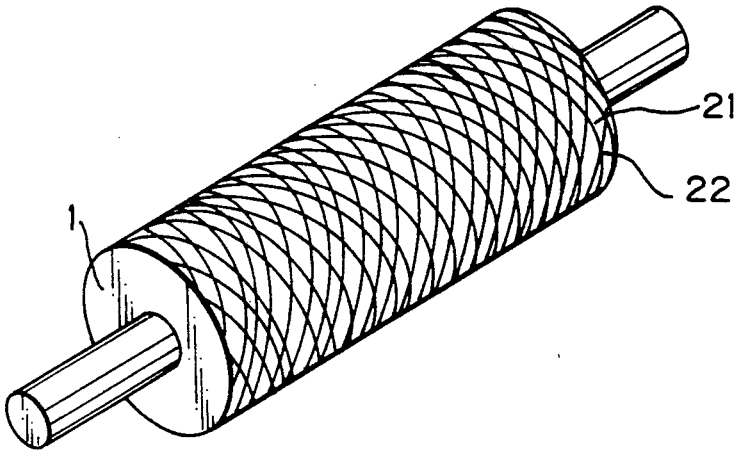
FIG. 2A is a perspective view showing a specific configuration of a developing roller included in the embodiment.
Figure 2B:
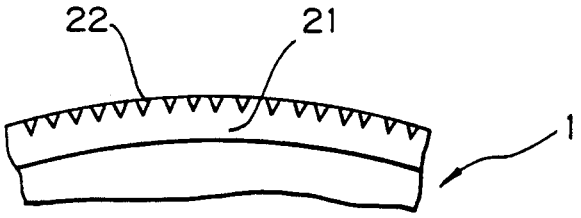
FIG. 2B is an enlarged section of a surface layer included in the developing roller of FIG. 2A.
Figure 4A:
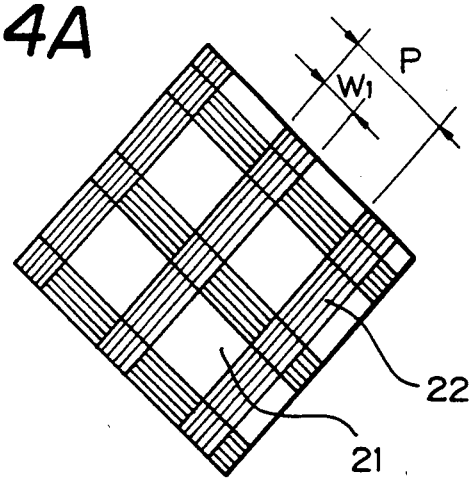
FIGS. 4A–4C are enlarged views each showing a specific surface configuration of a developing roller having insulating portions which have a particular width each.
Figure 4B:
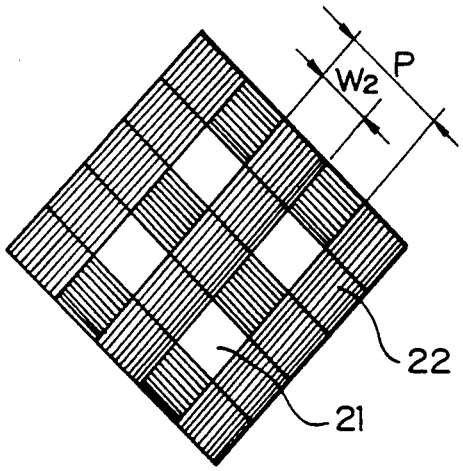
Figure 4C:
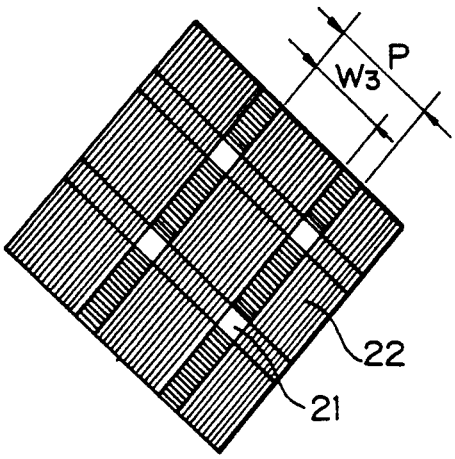

In the embodiment, the surface of the developing roller 1 is finely segmented into conductive portions and insulating portions. A specific configuration of the roller 1 is shown in a perspective view in FIG. 2A and in a fragmentary enlarged section in FIG. 2B. The roller 1 is made up of a plurality of substances each having a particular resistance or a particular dielectric constant. In the configuration of FIGS. 2A and 2B, a roller is made of conductive substance, e.g., aluminum or similar metal, conductive rubber or conductive plastic and has the surface thereof knurled in a mesh pattern, and then polycarbonate, acryl, polyester, tetrofluoroethylene or similar dielectric resin is filled in the recesses of the roller. As a result, the roller 1 has on the surface thereof fine mesh-like insulating portions 22 and fine conductive portions 21 adjoining the insulating portions 22. FIGS. 4A–4C each shows insulating portions 22 having a specific lattice pattern which is inclined 45 degrees relative to the moving direction (circumferential direction) of the roller 1. In the examples shown in FIGS. 4A–4C, the roller 1 is knurled at a pitch P of 0.3 mm, and the insulating portions 22 have a width W1 of 0.075 mm (FIG. 4A), a width W2 of 0.15 mm (FIG. 4B), or a width W3 of 0.225 mm (FIG. 4C). The insulating portions 22 and conductive portions 21 are distributed in combination over the surface of the roller 1.

It is to be noted that the above-described procedure for forming the two different kinds of portions 21 and 22 is only illustrative and may be replaced with any other suitable procedure.

The sizes and distances of the two portions 21 and 22 stated above are not limitative and may be suitably selected in relation to, among others, the bias for development which will be described. Particularly, when the insulating portions 22 are formed in a lattice pattern as shown and described, it is preferable that the lattice pattern be inclined 30–60 degrees relative to the moving direction of the developing roller 1 (direction perpendicular to the axis of the roller 1) and be provided with a width of 30–50 μm and a ratio of 30–80% to the entire surface area of the roller 1.

The insulating portions 22 have a mean diameter of 30–2000 μm, preferably 1000 μm. Assuming that the portions 22 have a circular shape, their diameter D1 (see FIG. 3) is selected to be 30–2000 μm, preferably about 100–400 μm, and the center-to-center distance P1 (see FIG. 3) between nearby portions 22 is adequately selected in a balanced condition. On the other hand, assuming that the portions 22 have a rectangular shape, their shortest side is dimensioned about 30–2000 μm. Likewise, when the portions 22 have an oval shape, their width on the shorter axis side is about 30–2000 μm. Even when the portions 22 have any other shape, the width is selected to lie in the range of about 30–2000 μm. The portions 22 may occupy 50–80%, preferably 65–75%, of the entire area of the surface of the roller 1. With such a configuration, it is possible to deposit a sufficient amount of toner 7 on the surface of the roller 1 when the toner supply roller 8 rubs the toner 7 against the roller 1.

Figure 3:
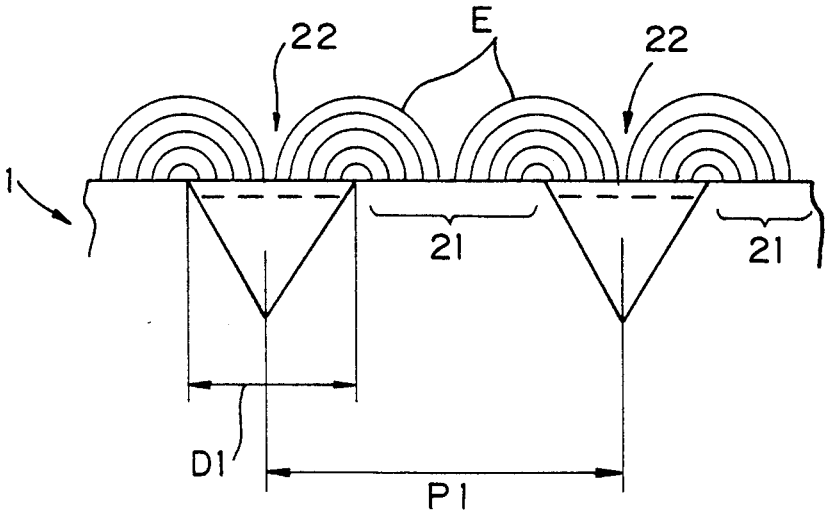
FIG. 3 is a schematic representation of electric lines of force which form microfields in the vicinity of insulating portions included in the developing roller of FIGS. 2A and 2B.

Why the above advantage is obtainable will be described more specifically. The insulating portions 22 are charged to the opposite polarity to the toner 7, i.e., to positive polarity by the toner supply roller 8. On the other hand, the toner 7 being conveyed toward the developing roller 1 in contact with the toner supply roller 8 is charged to negative polarity. On reaching the developing roller 1, the toner 7 is further negatively charged by the contact thereof with the roller 1, particularly the insulating portions 22, and electrostatically deposited on the roller 1. At this instant, since the insulating portions 22 are positively charged and the conductive portion 21 adjoin the insulating portions 22, a positive charge is deposited only on the numerous insulating portions 22. As a result, as shown in FIG. 3, a closed electric field is developed between each insulating portion 22 and conductive portion 21, i.e., numerous microfields E are developed in the vicinity of the surface of the roller 1. Assuming electric lines of force representative a field condition, numerous electric lines of force extending out from the developing roller 1 and returning to the roller 1 are formed in the space adjoining the surface of the roller 1, as indicated by curves in FIG. 3. Consequently, the microfield E is developed between each insulating portion 22 and conductive portion 21.

Since the insulating portions 22 each has an extremely small area, the microfield E is noticeably intensified by a fringing effect known in the art. The negatively charged toner 7 is strongly attracted onto the insulating portions 22 by such microfields E and firmly retained thereon. While the blade 4 regulates the thickness of the toner deposited on the developing roller 1, it removes part of the toner which is short of charge in contact therewith. Consequently, only the sufficiently charged toner 7, e.g., only the toner with a charge of about 5–20 μC/g, preferably 10–15 μC/g, is conveyed to the developing region by the developing roller 1. It is considered that in the developing region the pulse electric field having a rectangular waveform and implementing the bias for development acts on the microfields E and the charged toner 7 to give desirable dynamic energy for development.

In the developing device 2, the developing roller 1 and toner supply roller 8 are free from charge-up due to the arrangement of the conductive portions 21 and insulating portions 22 on the surface of the roller 1. This is presumably because the insulating portions 22 and the conductive portions 21 respectively charge and discharge the toner, maintaining a balanced charge condition as a whole.

In the illustrative embodiment, the linear velocity of the developing roller 1 is selected to lie in a ratio greater than or equal to 1.0 and smaller than or equal to 2.5, preferably greater than or equal to 1.0 and smaller than or equal to 1.2, to the linear velocity of the drum 3. When the roller 1 is driven at such a linear velocity, all the portions constituting the image area and non-image area of the drum 3 are caused to face both the insulating portions 22 and the conductive portions of the roller 1 with the result that a pattern corresponding to the distributions of the two different portions 21 and 22 is prevented from appearing on a reproduction. The linear speed should be provided with an upper limit capable of preventing the image density from increasing to an unusual degree at the trailing edge of an image, compared to the other portion of the image.

A more specific configuration of the embodiment will be described hereinafter.

The drum 3 is made of OPC and provided with a surface potential of −900 V in the background and a potential of −100 V in the exposed area. The developing roller 1 has the configuration shown in FIG. 4B and is spaced apart from the drum 3 by a distance of 100 μm for effecting reversal development. The drum 3 is rotated in a direction indicated by an arrow at a linear velocity Vp of 120 mm/s while the developing roller 1 is rotated in a direction indicated by an arrow at a linear velocity of 170 mm/s, i.e., at an about 1.4 times higher linear speed than the drum 3. The insulating portions 22 contacting the toner supply roller 8 hold a charge which sets up a potential of +200 V with respect to the ground potential, whereby the negatively charged toner 7 is deposited on the roller 1 in an amount of about 1.0–1.2 mg/cm$^2$. The bias applying means 9 applies to the developing roller 1 a pulse voltage having a peak-to-peak (P—P) voltage of 1000 V, maximum potential of 0 V, frequency of 500 Hz, and duty ratio of 30% ($T_2/T_1$).

Figure 5A:
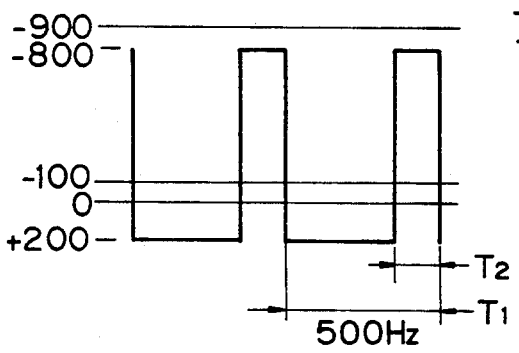
FIGS. 5A and 5B each shows a variation of the surface potential of a developing roller with respect to time which occurs in particular portions of the roller surface.
Figure 5B:
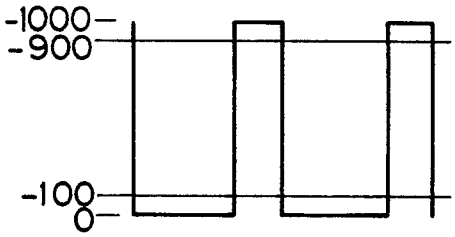

FIGS. 5A and 5B show respectively the variation of the surface potential of insulating portions 22 with respect to time and the variation of the surface potential of the conductive portions 21, taking the ground potential as a reference. In these figures, there are shown the level of the background surface potential of the drum 3 (−900 V) and the level of the surface potential of the exposed area (−100 V) as horizontal lines. The surface potential of the insulating portions 22 is offset by +200 V due to the charge held by the voltage from the bias applying means 9, as indicated by a rectangular continuous line shown in FIG. 5A. On the other hand, the surface potential of the conductive portions 21 is identical with the voltage from the bias applying means 9, as indicated by a rectangular continuous line in FIG. 5B.

Hereinafter will be described an electric field to appear between the developing roller 1 and the drum 3 in association with the variations of the potentials on the roller 1. The electric field differs from the insulating portions 22 to the conductive portions 21 of the developing roller 1 and from the image area to the background of the drum 1 for each of the two portions 21 and 22.

Figure 6A:
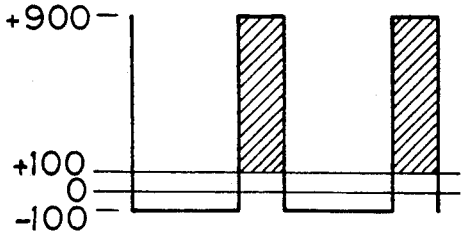
FIGS. 6A and 6B each shows a variation of an electric field developed on the conductive portions of the developing roller under a particular condition.
Figure 6B:
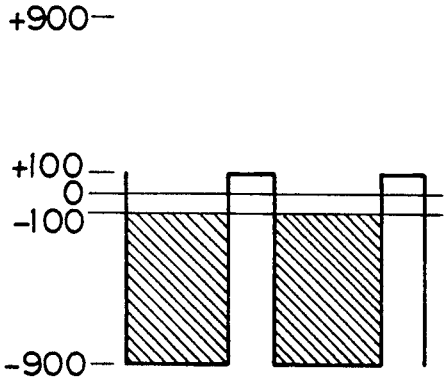
Figure 7A:
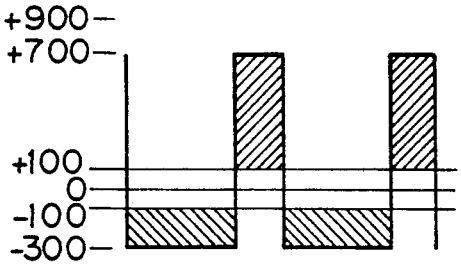
FIGS. 7A and 7B each shows a variation of an electric field developed on the insulating portions of the developing roller under a particular condition.
Figure 7B:
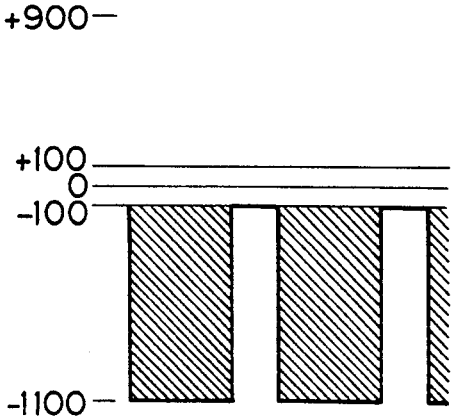

FIGS. 6A and 6B illustrate the electric field on the conductive portions 21 whose surface potential varies as shown in FIG. 5B. Specifically, FIG. 6A shows the variation of potential difference between the conductive portions 21 and the drum 3 occurring when the conductive portions 21 face the image area (exposed area) of the drum 3. FIG. 6B shows the variation of potential difference between the conductive portions and the drum 3 occurring when the former faces the background (unexposed area) of the latter. FIGS. 7A and 7B pertain to the electric field on the insulating portions 22 which varies as shown in FIG. 5A. Specifically, FIG. 7A shows the variation of potential difference between the insulating portions 22 and the drum 3 observed when the former faces the image area (exposed area) of the latter, while FIG. 7B shows the variation of the potential difference between the insulating portions 22 and the drum 3 observed when the former faces the background (unexposed area) of the latter.

The electric field exerts an electrostatic force on the toner 7 carried on the surface of the developing roller 1 or the surface of the drum 3. For this reason, in the above figures, the potential difference corresponding to the electric field which moves the toner toward the drum 3 and the potential difference corresponding to the electric field which moves it toward the developing roller 1 are represented by a positive sign and a negative sign, respectively, in order to distinguish the directions of the electrostatic force. Experiments showed that the threshold of the potential difference transferring the toner from the developing roller 1 to the drum 3 and the threshold of the electric field transferring it from the drum 3 to the developing roller 1 are respectively +100 V and −100 V, as indicated by horizontal lines in the above figures. Hatching indicates portions corresponding to an electric field which contributes to the toner transfer beyond the thresholds.

For the above experiments, the developing roller 1 and the drum 3 were spaced apart by a gap of 100 μm, and a DC voltage was applied to the roller 1 and changed to see the transfer of the toner. In this specific case, the threshold of the electric field for development was measured to be 1 V/μm while the charge deposited on the toner was found to be about 10 μC/g.

Presumably, when the toner 7 existing on the conductive portions 21 of the developing roller 1 faces the image area of the drum 3, it is transferred toward the drum 3 when an electric field for developing corresponding to the potential difference of +900 V is set up, as indicted by hatching in FIG. 6A. When such a toner faces the background of the drum 3, it presumably is transferred to the developing roller 1 when the electric field for development reaches −900 V, as indicated by hatching in FIG. 6B. Likewise, when the toner 7 existing on the insulating portions 22 faces the image area of the drum 3, a negative electric field of −300 V and a positive electric field of +700 V appear alternately, as indicated by hatching in FIG. 7A, since the portions 22 are originally charged to +200 V. Presumably, such a toner is transferred from the developing roller 1 to the drum 3 by the positive electric field and from the drum 3 to the developing roller 1 by the negative electric field. When the toner on the insulating portions 22 faces the background of the drum 3, it presumably is transferred from the drum 3 to the developing roller 1 by a negative electric field of −1100 V and not transferred back and forth between the drum 3 and the roller 1.

As stated above, the transfer of the toner 7 carried on the developing roller 1 is selectively controlled by the electric field developed on the roller 1.

The above-described image was compared with an image produced by a developing roller having a simple aluminum surface and the electric fields shown in FIGS. 6A and 6B. The comparison showed that the former is free from contamination in the background thereof and sufficiently high in density and, in addition, insures high reproducibility of lines, compared to the latter. With a developing roller having such a simple aluminum surface, reproducibility comparable with the reproducibility of the embodiment could only be attained at the cost of image density.

In the illustrative embodiment, the surface of the developing roller 1 include portions where a different bias for development acts. Hence, when a bias is applied between the drum 3 carrying a latent image and the roller 1 carrying the toner in order to effect development, the transfer of the toner can be selectively controlled by the roller 1. This is presumably why the above advantages are achievable. Specifically, positive and negative electric fields exceeding respective thresholds as shown in FIG. 7A act on the toner 7 existing in the insulating portions 22, preventing an excessive amount of toner deposition. On the other hand, the toner existing in the conductive portions 21 has a higher developing ability than the toner in the insulating portions 22, as FIG. 6A indicates. This, coupled with the fact that the portions 21 are conductive, suppresses the edge effect to thereby render the image density uniform.

More specifically, the developing roller 1 of the embodiment has both of the characteristics of two different types of developing rollers, i.e., a roller having an insulating surface and a roller having a conductive surface. A roller with an insulating surface has high reproducibility of lines and high tonality although image density available therewith is low, but the reproducibility and tonality would be lowered if the density were increased. A roller with a conductive surface is inferior to the roller with an insulating surface in respect of reproducibility and tonality although a high density image with uniform solid image portions is attainable due to the electrode effect.

The resulting image is free from a pattern corresponding to the lattice pattern of insulating portions 22 provided on the surface of the developing roller 1 and has a high image density as well as desirable reproducibility of lines.

Of course, an image free from contamination in the background thereof and having high density and desirable reproducibility of lines is achievable with any one of the specific configurations shown in FIGS. 4A and 4C in the same manner as with the configuration of FIG. 4B.

When the developing roller 1 and the drum 3 were spaced apart by a gap of 200 μm, it was found that the transfer of the toner 7 occurs when the electric field for development exceeds 200 V, i.e., that the threshold of electric field for development is also 1 V/μm. By further increasing the gap, it was proved that an image is obtainable up to the gap of about 500 μm with the bias voltage changed also, but the gap should preferably be less than 300 μm for acceptable images. When the roller 1 and the drum 3 were spaced apart 300 μm from each other, a pulse voltage exceeding 4500 V P—P caused a leak to occur between the roller 1 and the drum 3. This means that the electric field should be less than 15 V/μm.

When the insulating portions 22 of the developing roller 1 have a relatively small width W such as the width W1 shown in FIG. 4A, the pattern of the conductive portions 21 can be prevented from appearing in a reproduction if the roller 1 is driven at a higher speed than the drum 3. If the width of the insulating portions 22 is greater than the width of the conductive portions 21, the roller 1 may be driven at the same or slightly higher speed than the drum 3. In any case, a good result was achieved when the speed of the roller 1 was 1.0–2.0, preferably 1.0–1.2, times higher than that of the drum 3. When the roller configuration of FIG. 4B is replaced with the roller configuration of FIGS. 4A or 4C and the same pulse voltage was applied, the resulting image was also free from contamination in the back ground thereof and had high density and desirable reproducibility of lines.

The addition of silica particles to the toner 7 is advantageous for the following reasons.

Figure 8A:
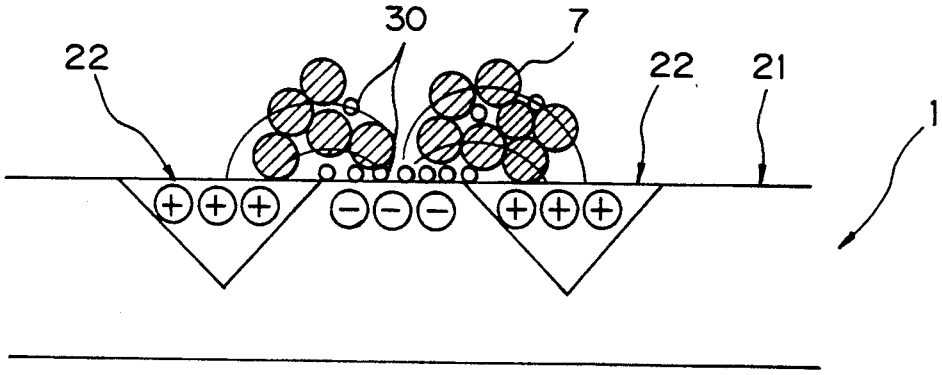
FIGS. 8A and 8C are enlarged views schematically showing silica particles on the surface of the developing roller under different operation conditions.
Figure 8B:
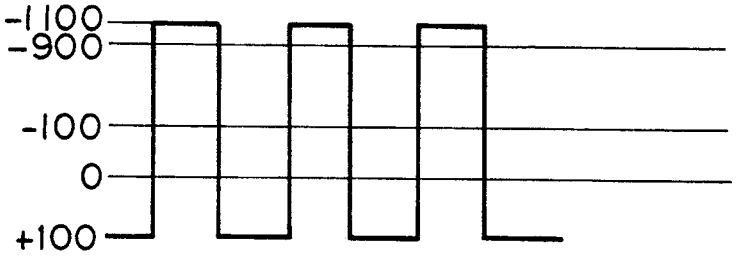
FIG. 8B shows a waveform representative of a specific bias for development.
Figure 8C:
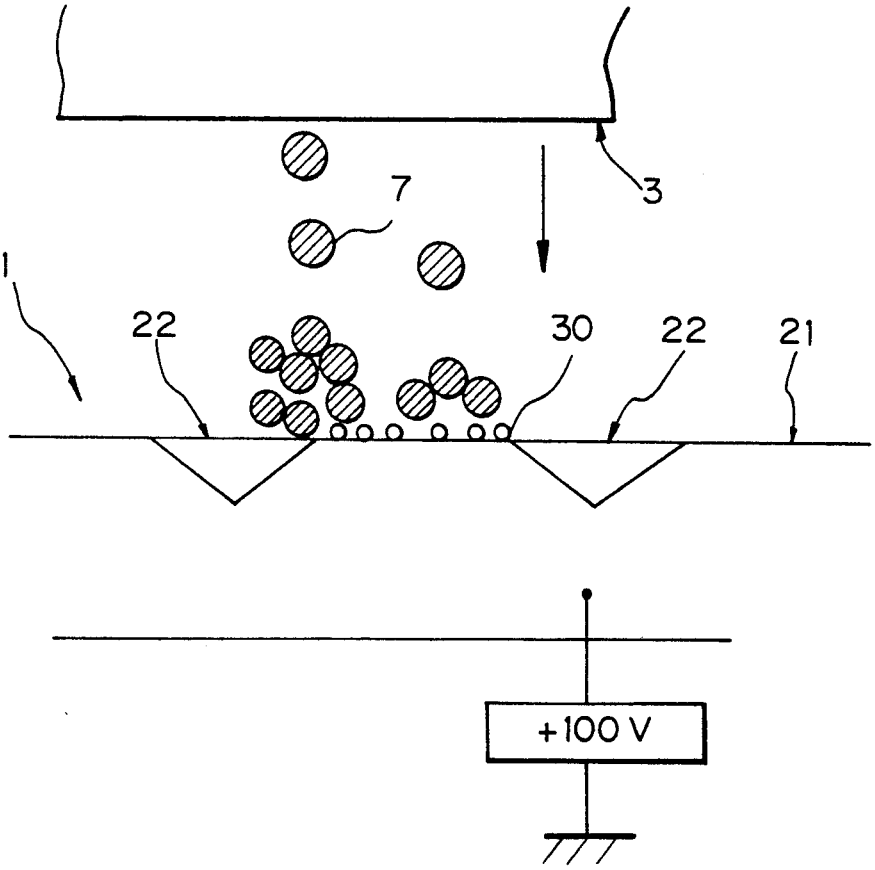

FIG. 8A is a schematic representation of the toner 7 and silica particles 30 deposited on the developing roller 1. As shown, the silica particles 30 fed to the surface of the developing roller 1 together with the toner 7 are charged to positive polarity in the embodiment due to the friction thereof with the toner 7 and the like. As a result, the silica particles 30 adhere to the negatively charged conductive portions 21 to thereby form a film. The film formed by the silica particles 30 eliminates charge injection into the toner 7 which would otherwise reduce the amount of charge of the toner 7 or charge it to the other polarity. This is true even when an electric field apt to cause charge injection from the conductive portions 21 to the toner 7 appears,. e.g., when use is made of a pulse voltage of 1200 V P—P on which DC −500 V is superposed, as shown in FIG. 8B. Specifically, assume that the bias voltage shown in FIG. 8B is applied to the developing roller 1. Then, at +100 V which maximizes the electric field acting in the direction for transferring the toner 7 from the drum 3 toward the roller 1, +100 V is applied to the toner 7 transferred from the drum 3 to the conductive portions 21 and the toner 7 originally existing on the portions 21 via the portions 21, as schematically shown in FIG. 8C. In such a condition, it is likely that positive charge is injected from the conductive portions 21 into the toner 7 or the toner has the charge thereof reduced or is unwantedly charged to positive polarity. Such an occurrence would contaminate the background of the reproduced image.

Figure 9A:
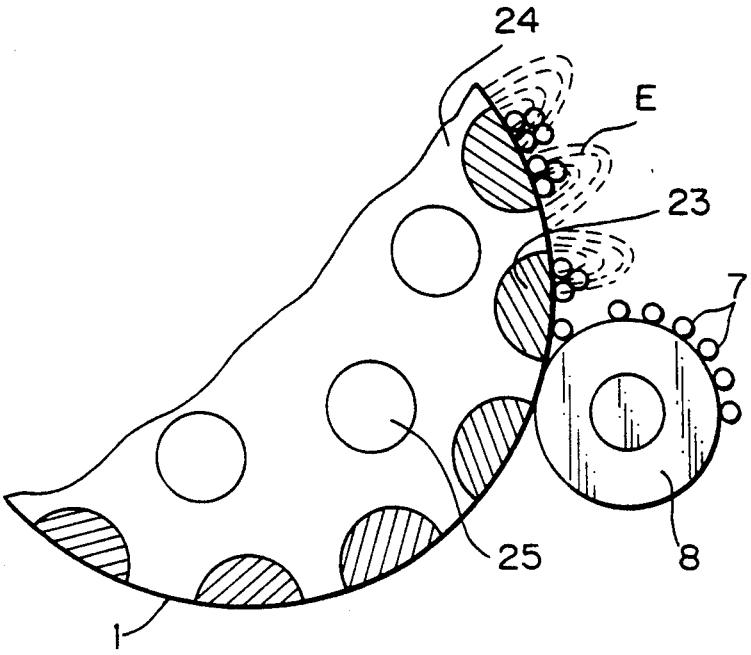
FIGS. 9A–9C are enlarged views showing an alternative embodiment of the present invention.

Referring to FIG. 9A, an alternative embodiment of the present invention is shown which is essentially similar to the above embodiment except for the configuration of the developing roller. As shown, dielectric portions 23 and conductive portions 24 are exposed to the outside on the surface of the developing roller 1 in a regular or irregular arrangement, and each has an extremely small area. Assuming that the portions 23 and 24 on the surface of the roller 1 are circular, they have a diameter of 10–500 μm each. Preferably, the conductive portions 24 assume 20–60% of the total surface area of the roller 1.

In operation, the surface portion of the developing roller 1 performed development is brought into contact with the toner supply roller 8 due to the rotation the roller 1. The toner supply roller 8 mechanically and electrically removes the toner remaining on the surface portion of the roller 1 of interest while charging the dielectric portions 23 by friction. At this instant, the charges deposited on the roller 1 and toner by the development are uniformized, or initialized, by the friction. The toner 7 conveyed by the toner supply roller 8 is charged by friction and electrostatically deposited on the dielectric portions 23 of the roller 1. This part of the toner 7 is charged to the opposite polarity to the drum 3 while the dielectric portions 23 of the roller 1 are charged to the same polarity as the drum 3. The microfields E formed on the roller 1 increase the electric field gradient with the result that the toner 7 is deposited in multiple layers of the roller 1. The toner 7 is firmly retained on the roller 1 due to the microfields. The toner 7 forming multiple layers on the roller 1 is regulated by the blade 4 and then brought to the developing region, FIG. 1. In the developing region, the electric field between the roller 1 and the drum 3 (see FIG. 1) enhances the electrode effect to allow the toner on the roller 1 to easily adhere to the drum 3.

The developing roller 1 of the embodiment will be described specifically. The dielectric portions 23 appear on the surface of the roller 1 together with the conductive portions 24 and are formed in foam cells 25 located close to the surface of a conductive foam layer. While the dielectric portions 23 in the foam cells 25 may be made of any suitable material so long and it is insulating, the material should preferably have a volume resistivity higher than $10^{10}$ Ωcm, especially higher than $10^{14}$ Ωcm. The insulating material may be selected from a group of organic polymers including vinyl resins such as polyvinyl chloride, polyvinyl butyral, polyvinyl alcohol, polyvinylidene chloride, polyvinyl acetate, and polyvinyl formal; polystyrene resins including polystyrene, styrene-acrylnitril copolymer, and acrylonitril-butadien-styrene copolymer; polyethylene resins including polyethylene and ethylene-vinyl acetate copolymer; acryl resins including polymethyl metacrylate and polymethyl metacrylate-styrene copolymer; resins including polyacetar, polyamide, cellulose, polycarbonate, phenoxy resins, polyester, fluoric resin, polyurethane, phenolic resin, urea resin, melamine regen, epoxy resin, unsaturated polyester resin, and silicone resin; and rubbers including natural rubber, isoprene rubber, styrene-butadien rubber, butyl rubber, ethylene-propyrene rubber, chloroprene ruffer, chlorinated polyethylene rubber, epichlorohydrin rubber, nitril rubber, acryl rubber, urethane rubber, polysulfide rubber, silicone rubber, and fluoric rubber.

In the embodiment, the insulating material is of the kind mainly constituted by an aliphatic fluorine-containing compound or silicone resin.

Typically, the aliphatic fluorine-containing compound may be polytetrafluoroethylene, polyvinylidene fluoride, tetrafluoroethylene-hexafluoropropyrene copolymer, tetrafluoroethylene-per-fluoroalkylvinylether copolymer, tetrafluoroethylene-ethylene copolymer, polychlorotolufluoroethylene or similar polymer containing fluorine, or aliphatic fluorocarbon or aliphatic fluorochlorocarbon having ether radicals, carboxyl radicals, hydroxyl radicals or similar polar radicals at at the ends or in the molecular chain. The silicone resin may be of condensation type, addition type or peroxide hardening type or may be degenerated resin produced by copolymerizing organic resin.

In the embodiment, the conductive portions 24 are implemented by a conductive foam layer. Foam resin may be selected from a group of organic polymers including natural rubber, isoprene rubber, butadien rubber, styrene-butadien rubber, butyl rubber, ethylene-propyrene rubber, chloroprene rubber, chlorinated polyethylene rubber, epichlorohydrine rubber, nitril rubber, acryl rubber, urethane rubber, polysulfide rubber, silicone rubber, fluoric rubber, and silicone degenerated ethylene-propyrene rubber. Regarding an agent for providing conductivity, use may be made of metal powder such as nickel powder or copper powder; carbon black such as furnace black, lamp black, thermal black, acetylene black or channel black; conductive oxide such as tin oxide, zinc oxide, molybdenum oxide, antimony oxide or potassium titanate; unelectrolytic plating such as plated titanium oxide or plated mica; or graphite, metal fiber or carbon fiber.

Further, a foaming agent may be implemented by either of conventional organic and inorganic foaming agents. Specifically, use may be made of azobisisobuthylonitril, azodicarbonamide, benzensulphonyl hydrazide, or p,p'-oxybiabenzenesulphonyl trilhydrazide.

Figure 9B:
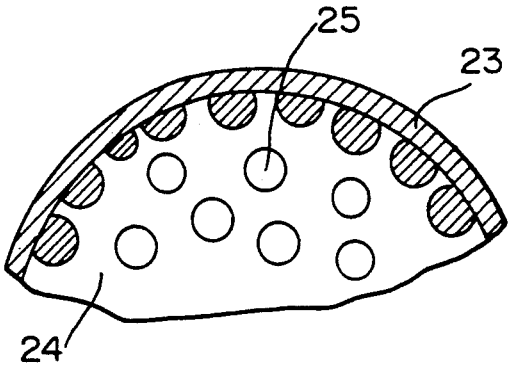
Figure 9C:
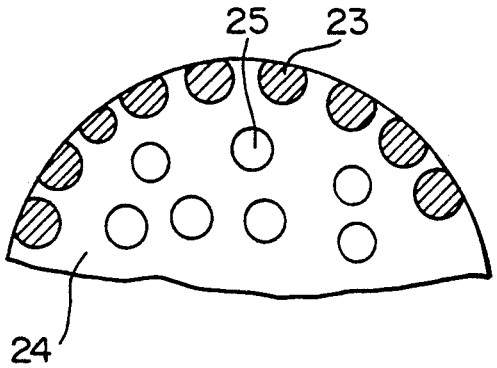

A specific procedure for fabricating the developing roller 1 of this embodiment is as follows. A conductive foam composition made up of rubber, conductivity providing agent, foaming body and other additives is subjected to extrusion molding to form an elastic foam layer on the outer periphery of a metallic core. The surface of the foam layer is ground to expose the foam cells to the outside, thereby forming recesses for burying a dielectric substance. Then, a dielectric substance is filled in the recesses by spraying, dipping or similar conventional technology. The dielectric material is hardened (baked) under predetermined conditions (temperature and period of time) (the coating has a thickness great enough to completely fill the recesses) (see FIG. 9B). Finally, the surface of the resulting roller 1 is ground or polished to cause the conductive portions and dielectric portions each having an extremely area to appear on the surface, the conductive potions occupying 20–60% of the entire surface (see FIG. 9C).

More specific examples of the above procedure will be described hereinafter.

EXAMPLE 1

A conductive foam composition (I) consisted of 100 Wt % of diorganopolysiloxane (average degree of polymerization higher than 2000; KF901F-U (trade name) available from Shinetsu Chemical (Japan)), 10 Wt % of furnace black (Ketchen Black EC (trade name) available from Lion Aczo (Japan)), 2 Wt % of dicumenyl peroxide, and 2 Wt % of azobisisobutylonitril. The foam composition (I) was extrusion-molded on the the periphery of a metallic core undegone primer treatment beforehand, then cured in a metal mold at 170° C. for 20 minutes, and then cured at 200° C. for 2 hours to produce a developing roller 1. The roller 1 had a conductive foam layer having a volume resistivity of $10^{11}$ Ωcm, specific gravity of 0.57, and foam cells sized 30–50 μm. The surface of the roller 1 was ground to expose the foam cells 25 to thereby form recesses for burying a dielectric substance. A dielectric substance was composed of 150 Wt % of fluoric resin composition (mainly constituted by Lumifron LF601-C (trade name) available from Asahi Glass (Japan)) and coated on the roller 1 to fully fill the recesses and then hardened by bridging. Thereafter, the surface of the roller 1 was ground or polished to cause the conductive portions and dielectric portions to appear on the roller surface together, the conductive portions occupying 50% of the entire roller surface.

EXAMPLE 2

Example 1 was repeated except that the conductive foam composition (I) was replaced with a conductive foam composition (II) made up of 100 Wt % of diorganopolysiloxane (average degree of polymerization higher than 2000; KF901F-U (trade name) available from Shinetsu Chemical (Japan)), 30 Wt % of furnace black (Ketchen Black EC (trade name) available from Lion Aczo (Japan)), 5 Wt % of dicumyl peroxide, and 10 Wt % of azobisisobutylonitril, and that the conductive foam layer had a volume reistivity of $10^6$ Ωcm, specific gravity of 0.31, and foam cells sized 90–120 μm.

EXAMPLE 3

Example 1 was repeated except that the conductive foam composition (I) was replaced with a conductive foam composition (III) constituted by 100 Wt % of diorganopolysiloxane (average degree of polymerization higher than 2000; KF901F-U (trade name) available from Shinetsu Chemical (Japan)), 50 Wt % of furnace black (Ketchen Black EC (trade name) available from Lion Aczo (Japan)), 10 Wt % of dicumyl peroxide, and 14 Wt % of azobisisobutyloniril, and that the conductive foam layer had a volume resistivity of $10^2$ Ωcm, specific gravity of 0.23, and foam cells sized 200–460 μm.

EXAMPLE 4

Example 1 was repeated except that the fluoric resin was replaced with an addition type silicone resin composition (SR2407 (trade name) available from Tore Silicone (Japan).

EXAMPLE 5

Example 1 was repeated by using the composition of Example 3 except that the fluoric resin was replaced with an addition type silicone resin composition (SR2407 (trade name) available from Tore Silicone (Japan)).

EXAMPLE 6

Example 1 was repeated by using the composition of Example 3 except that the fluoric resin was replaced with an addition type silicone resin composition (SR2407 (trade name) available from Tore Silicone (Japan)).

EVALUATION

Each of the developing rollers 1 produced by Examples 1–6 was mounted on the developing device to measure the amount of charge to be deposited on a toner and the amount of toner deposition. The developing device had the blade 4 made of urethane rubber, toner supply member 8 made of conductive urethane sponge, and positively chargeable toner 7. The results of measurement are shown in Table 1 below

TABLE 1

| | ITEM | |
|---|---|---|
| EX. NO. | CHARGE ON TONER (μC/g) | DEPOSITION OF TONER (mg/cm²) |
| EX. 1 | 10.3 | 1.05 |
| EX. 2 | 13.4 | 1.20 |
| EX. 3 | 14.1 | 1.19 |
| EX. 4 | 12.6 | 1.19 |
| EX. 5 | 14.7 | 1.22 |
| EX. 6 | 13.5 | 1.18 |

As Table 1 indicates, a sufficient amount of charge and a sufficient amount of toner deposition are achievable with the embodiment.

In this embodiment, too, it is likely that charge injection occurs from the conductive portions 24 to the toner to reduce the amount of charge, as has been the case with the conductive portions 21 of the previous embodiment. It is, therefore, desirable to use a toner to which silica particles are added, so that the background of the resulting image may be free from contamination.

Figure 10A:
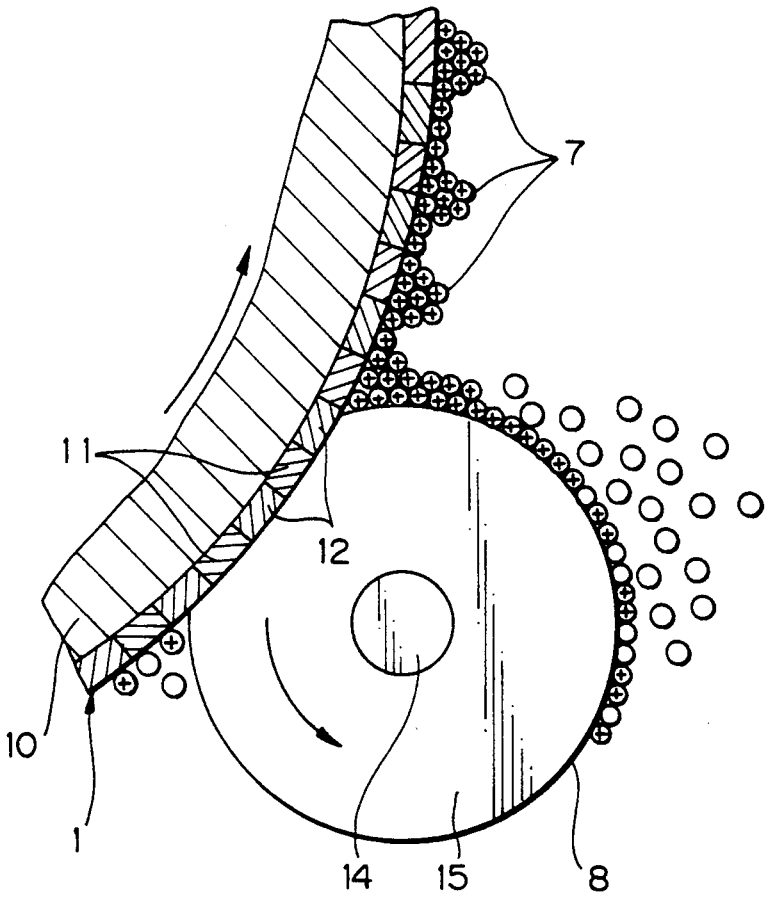
FIG. 10A shows still another embodiment of the present invention.

A reference will be made to FIGS. 10A–10C for describing another embodiment of the present invention which is essentially identical with the first embodiment except for the configuration of the developing roller 1. As shown in FIG. 10A, the developing roller 1 has a base 10 implemented as a conductive roller made of aluminum, iron, copper or similar metal, and medium resistance bodies 12 and high resistance bodies 11 which are affixed to the periphery of the conductive base 10. The resistance bodies 11 and 12 are implemented by dielectric bodies having at least different resistivities, and each has a particular charging characteristic. The resistivity of the resistance bodies 12 is higher than that of the surface of the base while the resistivity of the resistance bodies 11 is even higher than that of the resistance bodies 12 and may be $10^3$–$10^{15}$ Ωcm. The resistance bodies 11 and 12 are made of dielectric bodies having such resistivities.

Figure 10B:
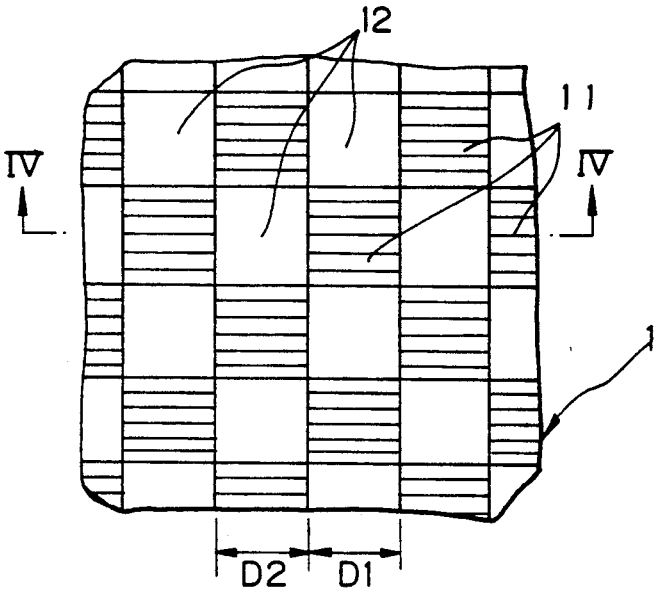
FIG. 10B is an enlarged plan view schematically showing dielectric bodies included in the embodiment of FIG. 10A.
Figure 10C:
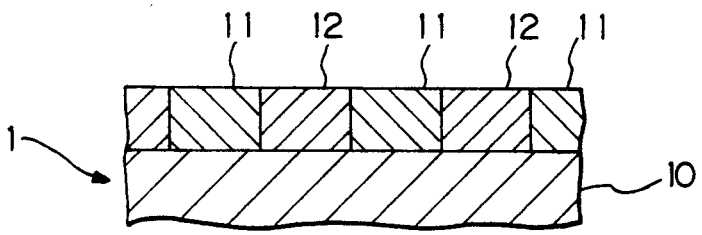
FIG. 10C is a section along line IV—IV of FIG. 10B.

In FIG. 10B, as well as in FIGS. 11A–11D, the high resistance bodies 11 are provided with shadows for the distinction thereof from the medium resistance bodies 12. As shown in FIGS. 10A–10C, the high resistance bodies 11 and medium resistance bodies 12 are arranged in a regular pattern (or possibly in an irregular pattern) and exposed to the outside on the surface of the developing roller 1. The shape of the resistance bodies 11 and 12 are open to choice. When the resistance bodies 11 and 12 are each provided with a rectangular shape, as shown in FIG. 10B, each side thereof D1 or D2 may lie in a range of 10–500 μm. The sizes and resistivities of the resistance bodies 11 and 12 may be suitably selected so long as they are capable of intensifying microfields, which will be described, to deposit an optimal amount of toner on the developing roller 1. In the embodiment, the high resistance and medium resistance bodies 11 and 12 are each made of a substance which is chargeable to the opposite polarity to the toner, i.e., to negative polarity by friction. If desired, a bias voltage, e.g., DC, AC, DC-superposed AC or pulse may be applied to the conductive base 10 of the developing roller 1 to further enhance image quality. A predetermined voltage identical with or different from the voltage to the roller 1 may also be applied to the toner supply roller 8, if necessary. When the developing roller 1 is replaced with a belt, the two kinds of resistance bodies will be affixed to the surface of a conductive base of the belt in the previously stated arrangement.

On the other hand, the toner supply roller 8 is made of a substance capable of frictionally charging the high resistance and medium resistance bodies 11 and 12 to the opposite polarity to the toner, i.e., to negative polarity in contact with them. In the construction shown in FIG. 10A, the roller 8 is made up of a conductive core 14 and a hollow cylindrical foam body (e.g. urethane foam) 15 provided on the core 14. The foam body 15 elastically deforms in contact with the developing roller 1. When use is made of such a toner supply roller 8, the foam body 15 will be made of a substance capable of charging the resistance bodies 11 and 12 to negative polarity, as stated above. The foam body 15 may be replaced with a fur brush or similar conventional implement.

Figure 10D:
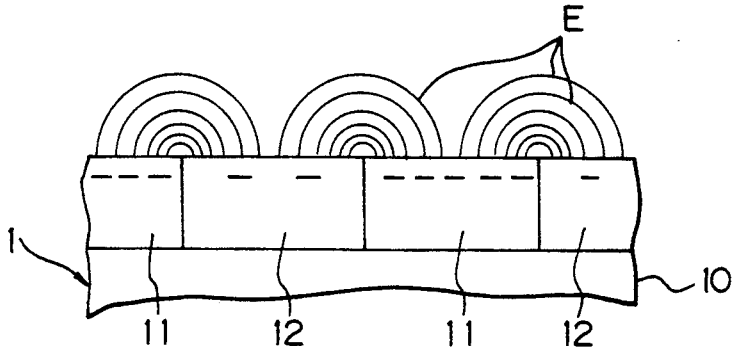
FIG. 10D shows electric lines of force forming microfields in the vicinity of the surface of the developing roller depicted in FIG. 10A.

In the above construction, the high resistance and medium resistance bodies 11 and 12 are charged by the toner supply roller 8, as stated above. Even if an afterimage electrostatically remains on the resistance bodies 11 and 12 having passed the developing region due to the influence of the latent image on the drum 3, the resistance bodies 11 and 12 are charged to substantially the saturation level by the friction thereof with the toner supply roller 8. Hence, the afterimage is erased to initialize the developing roller 1. On the other hand, the toner 7 being conveyed toward the developing roller 1 by the toner supply roller 8 is positively charged by the roller 8. Then, the toner 7 is further positively charged on contacting the developing roller 1 to be thereby electrostatically deposited on the roller 1. In the above condition, despite that both of the resistance bodies 11 and 12 of the developing roller 1 are negatively charged by the toner supply roller 8, their surface potentials are different from each other since their resistivities are different, i.e., the charge of the high resistance bodies 11 is greater in amount that the charge of the medium resistance bodies 12, as schematically represented by FIG. 10D. As a result, microfields are developed between the resistance bodies 11 and 12. Specifically, numerous microfields are formed on the developing roller 1 in a uniform distribution since the numerous resistance bodies 11 and 12 are arranged on the conductive base alternately. Assuming electric lines of force representative of an electric field, electric lines of force E are formed in the space close to the surface of the developing roller 1, as indicated by a number of curves in FIG. 10D. Each electric line of force E leaves the developing roller 1 and returns to it.

The surface of each of the resistance bodies 11 and 12 has an extremely small size and, therefore, the resulting microfield is extremely small, so that the microfield is noticeably intensified by the edge effect or the fringing effect. As shown in FIG. 10A, the toner 7 positively charged by such intense microfields are strongly attracted onto the surface of the high resistance bodies 11 and, therefore, firmly retained in a great amount on the developing roller 1. More specifically, the charged toner is restricted within the microfields by intense forces and retained on the developing roller 1 along the electric lines of force. At this instance, the toner is intensely charged due to the friction of the toner supply roller 8 and developing roller 1 and, in addition, retained on the roller 1 by the intense microfields. Therefore, when the toner on the roller 1 is regulated by the blade 4, only the toner short of charge and mixed with the sufficiently charged toner is removed by the blade 4. As a result, only the sufficiently charged toner is conveyed to the developing region in a greater amount than conventional. The electric field between the developing roller 1 and the drum 3 in the developing region promotes easy deposition of the toner on the drum 3 due to a greater electrode effect. Consequently, the toner image has the density thereof increased and is free from contamination in the background thereof.

While FIG. 10D shows a specific case wherein only the microfields are formed over the entire surface of the developing roller 1, it is likely that electric fields different from the microfields exist together with the microfields. In any case, the intensity is increased since microfields do exist, so that a great amount of toner is deposited on the developing roller 1.

It is noteworthy that the high resistance and medium resistance bodies 11 and 12 arranged on the developing roll 1 cover the entire conductive surface of the conductive base 10. In the developing region, therefore, the leak of charge is surely suppressed between the drum 3 and the developing roller 1, so that the latent image on the rum 3 is free from disturbance.

Again, charge injection from the conductive portions 21 to the toner and, therefore, the reduction of the amount of charge of the toner is likely to occur, depending on, among others, the resistance of the medium resistance bodies 12. For this reason, this embodiment, too, should advantageously be implemented with the mixture of toner and silica particles in order to eliminate contamination of the background.

The non-contact development shown and described may be replaced with contact development. While the embodiment charges the high resistance and low resistance bodies 11 and 12 to the opposite polarity to the toner, the former may be charged to the same polarity with the latter to deposit a greater amount of toner on the medium reisitance bodies 12. If desired, only the high resistance bodies 11 may be charged to a predetermined polarity to form microfields between them and the medium resistance bodies 12. The gist is that at least the high resistance bodies 11 are charged to form microfields on the basis of the difference of surface potentials.

Figure 11A:
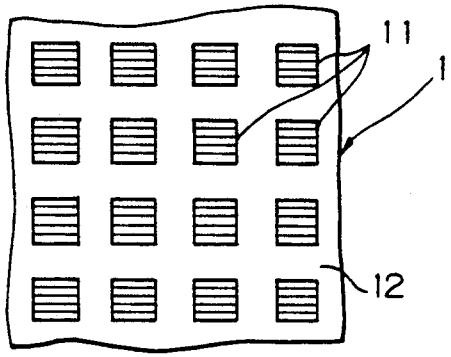
FIGS. 11A–11D each shows another specific arrangement of dielectric bodies.
Figure 11B:
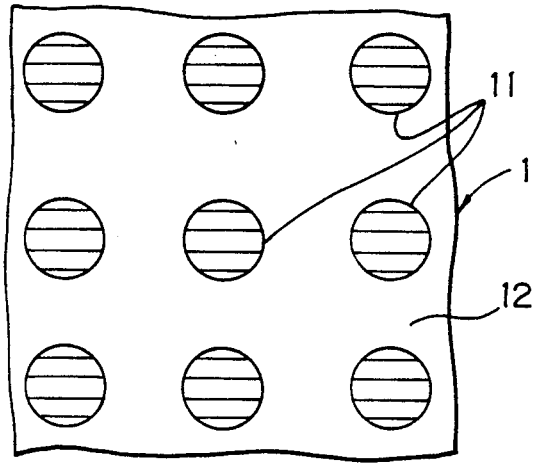
Figure 11C:
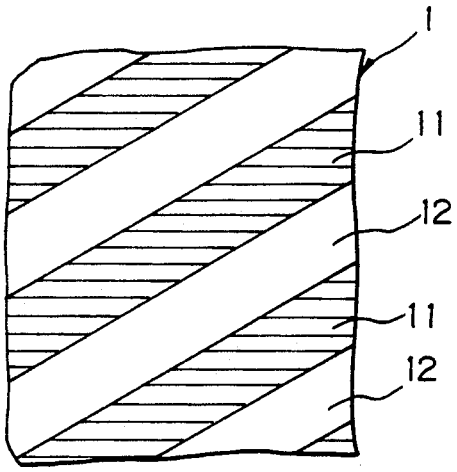
Figure 11D:
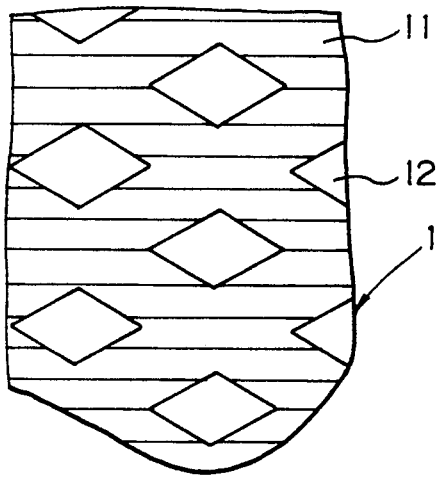

Not only the surface configurations and sizes of the resistance bodies 11 and 12 but also the arrangement thereof are open to choice. For example, as shown in FIGS. 11A and 11B, the high resistance bodies 11 having a suitable surface configuration may be distributed in the medium resistance body 12. Conversely, as shown in FIG. 11D, the medium resistance bodies 12 having a suitable configuration may be distributed in the high resistance body 11. Further, as shown in FIG. 11C, the resistance bodies 11 and 12 may be implemented as stripes alternating with each other. When the high resistance bodies 11 (or medium resistance bodies 12) has a circular surface configuration shown in FIG. 11B, they may be provided with a diameter of 10–500 μm, particularly about 500–300 μm. When each high resistance body 11 is implemented as a stripe as shown in FIG. 11C, it may have a width and a distance to nearby strips which are about 10–500 μm each.

The base 10 for affixing the high resistance and low resistance bodies 11 and 12 may be provided with a conductive layer on only the surface thereof. The conductive layer may be connected to ground, or a predetermined bias voltage may be applied to the conductive layer.

In the embodiment of FIG. 10A, the toner supply roller 8 plays the role of charging means for charging at least the high resistance bodies 11 to a predetermined polarity, so that the non-magnetic toner for development may be deposited on the developing roller 1 by microfields. Alternatively, the charging means may be constituted by a charging member independent of the toner supply roller 8.

Figure 12:
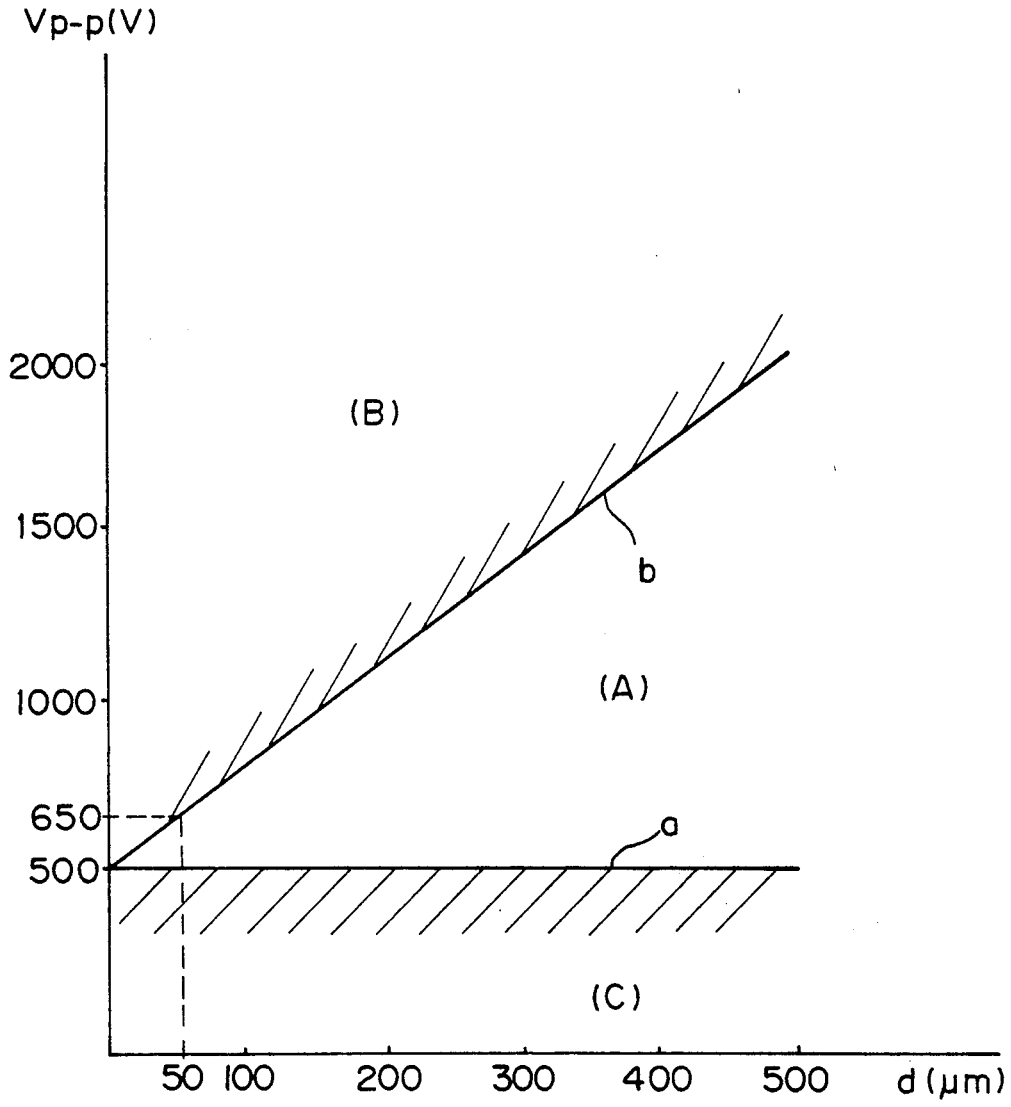
FIG. 12 is a graph indicative of an adequate range of potential difference between the maximum and minimum voltages of the wavefom of a bias voltage.

The bias applying means 9 included in the developing device 2 of FIG. 1 applies an adequate bias voltage which is determined, as follows. When the developing roller 1 and the drum 3 were spaced apart 50–500 μm and the alternating bias voltage for development had the waveform and frequency thereof changed, the adequate range of potential difference Vp−p between the maximum and minimum voltages of the voltage waveform was found to be higher than or equal to 500 V and lower than or equal to 3d+500 where d is the gap (μm) between the roller 1 and the drum 3. FIG. 12 is a graph indicative of such a relation. In FIG. 2, lines a and b indicate respectively the lower limit and the upper limit of the adequate range and define an adequate range (A) therebetween. When Vp−p lies in a range (B) above the line b, the background is contaminated to lower the contrast of an image. Conversely, when Vp−p lies in a range (C) below the line a, the reproducibility of lines, i.e., sharpness is lowered. In the adequate range (A), it was determined that more than 70% of toner flies to realize an image having desirable tonality and sharpness.

On the other hand, when the developing roller 1 and the drum 3 were held in contact with each other to effect contact development, the above-stated adequate range of potential difference Vp−p (V) was found to lie in a range higher than or equal to 500 V and lower than or equal to 650 V. The lower limit is equal to the lower limit mentioned above in relation to non-contact development. The upper limit, i.e., 650 V corresponds to the upper limit associated with the gap of 50 μm of non-contact development. This is presumably because despite that the roller 1 and drum 3 contact each other, the toner flies in positions preceding and following the point of contact and where the gap is about 50 μm. Again, experiments showed that the background is contaminated to lower the contrast in the range above the upper limit of 650 V while the sharpness is degraded in the range below the lower limit of 500 V. When Vp−p was confined in the adequate range, more than 90% of toner flew to enhance image density, sharpness, and tonality.

Regarding the frequency of the alternating voltage, experiments proved that a low frequency range of 250–2000 Hz, preferably 500–1500 Hz, is desirable from the density, sharpness and clear background standpoint with no regard to contact/non-contact development.

Since the developing roller 1 forming microfields is used, the lower limit of bias voltage should be higher than that of a conventional developing roller by an amount matching the attraction exerted by the microfields in both of contact development and non-contact development.

In summary, it will be seen that the present invention provides a developing device capable of depositing an adequate amount of developer on an electrostatic latent image formed on a photoconductive element, thereby enhancing image density while preserving tonality and, in addition, preventing lines from being thickened. An image is free from a pattern ascribable to an electric field arrangement provided on the surface of a developing roller and, therefore, achieves excellent quality. An adequate range of bias voltage to be applied to the developing roller is determined to insure an image having high density, sharpness and tonality and free from contamination in the background thereof. Use is made of a developer which is a combination of non-magnetic toner and silica particles to eliminate the contamination of the background ascribable to the short charge or the reverse charge of the developer.

Various modifications will become possible for those skilled in the art after receiving the teachings of the present disclosure without departing from the scope thereof.

What is claimed is:

1. A developing device incorporated in an image forming apparatus for developing, in a developing region, an electrostatic latent image formed on an image carrier by a non-magnetic developer to which silica particles are added, said device comprising:

a developer carrier, comprising a conductive base, and low conductivity surface regions and high conductivity surface regions in electrical contact with said conductive base, for forming a number of microfields on the surface thereof; and bias applying means for applying a bias voltage to said conductive base of said conductive developer carrier;

the developer being controllably moved by an electric field determined by a potential deposited on said image carrier, an electric field developed by said bias voltage applied from said bias applying means, and an electric field developed by the microfields on the surface of said developer carrier.

2. A device as claimed in claim 1, wherein said developer carrier comprises said base having conductive portions and dielectric portions which are exposed to the outside on the surface of said base of said developer carrier together in a regular or irregular arrangement, at least said dielectric portions having the surfaces thereof appearing on said surface of said developer carrier charged to a predetermined polarity to form said number of microfields.

3. A device as claimed in claim 1, wherein said base of said developer carrier comprises conductive portions and dielectric portions formed in foam cells adjoining the surface of a conductive foam layer, said conductive portions and said dielectric portions being exposed to the outside on the surface of said developer carrier together and each having an extremely small area, at least said dielectric portions having the surfaces thereof appearing on said surface of said developer carrier charged to a predetermined polarity to form said number of microfields.

4. A device as claimed in claim 1, wherein said base of said developer carrier comprises an elastic conductive substance containing insulating particles, conductive portions and dielectric portions being exposed to the outside on the surface of said developer carrier together and each having an extremely small area, at least said dielectric portions having surfaces thereof appearing on said surface of said developer carrier charged to a predetermined polarity to form said number of microfields.

5. A device as claimed in claim 1, wherein said developer carrier comprises a first and a second substance formed on said conductive base to appear on the surface of said developer carrier together in a regular or irregular arrangement and each having a particular resistance, at least one of said first and second substances higher in resistance than the other having the surface thereof appearing on said surface of said developer carrier charged to a predetermined polarity to form said microfields.

6. A device as claimed in claim 1, further comprising drive means for driving said developer carrier at a linear velocity which is in a ratio greater than or equal to 1.0 and smaller than or equal to 2.5 to the linear velocity of said image carrier.

7. A device as claimed in claim 1, further comprising drive means for driving said developer carrier at a linear velocity which is in a ratio greater than or equal to 1.0 and smaller than or equal to 1.2 to the linear velocity of said image carrier.

8. A device as claimed in claim 1, wherein said developer carrier comprises a first and a second substance each having a particular resistance or a particular dielectric constant and exposed to the outside on the surface of said base of said developer carrier together in a regular or irregular arrangement, at least one of said first and second substances higher in resistance or lower in dielectric constant than the other having the surfaces thereof appearing on said surface of said base charged to a predetermined polarity to form said number of microfields.

9. A device as claim in claim 8, wherein one of said first and second substances higher in resistance or lower in dielectric constant than the other is arranged on the surface of said developer carrier in a lattice configuration which has a width lying in a range of 30–500 μm and a total area occupying 30–80% of the total area of said surface of said developer carrier and is inclined 30–60 degrees relative to an intended direction of movement of said surface of said developer carrier.

10. A device as claimed in claim 1, wherein said developer carrier and said image carrier face each other in a non-contact condition, said bias voltage comprising an alternating voltage having such a waveform that a potential difference $Vp-p$ (V) between the maximum and minimum potentials is higher than or equal to 500 and lower than and equal to $3d+500$ where d (μm) is a gap between said image carrier and said developer carrier and greater than 50 and smaller than 500.

11. A device as claimed in claim 10, wherein said alternating bias voltage has a frequency of 250–2000 Hz.

12. A device as claimed in claim 1, wherein said developer carrier and said image carrier face each other in a contact condition, said bias voltage comprising an alternating voltage having such a waveform that a potential difference $Vp-p$ (V) between the maximum and minimum voltages is higher than or equal to 500 and lower than or equal to 650.

13. A device as claimed in claim 12, wherein said alternating bias voltage has a frequency of 250–2000 Hz.

* * * * *